United States Patent [19]

Fuller et al.

[11] 3,984,020

[45] Oct. 5, 1976

[54] RACK EXTRACTOR DEVICE

[75] Inventors: Richard C. Fuller; Jefferson D. Kirkpatrick, both of Lockport, N.Y.

[73] Assignee: General Motors Corporation, Detroit, Mich.

[22] Filed: Aug. 11, 1975

[21] Appl. No.: 603,341

[52] U.S. Cl. ..... 214/620; 214/750

[51] Int. Cl.[2] ..... B66F 9/12

[58] Field of Search ..... 214/38 CC, 620, 621, 214/730, 731, 750

[56] References Cited

UNITED STATES PATENTS

| | | | |
|---|---|---|---|
| 2,271,624 | 3/1942 | Cochran | 214/731 |
| 2,536,068 | 1/1951 | Lehmann | 214/750 X |
| 2,547,329 | 4/1951 | Lapham | 214/620 X |
| 2,682,350 | 6/1954 | Garrett | 214/730 |
| 3,489,305 | 1/1970 | Palmateer | 214/620 |
| 3,556,328 | 1/1971 | Miles et al. | 214/620 |
| 3,561,628 | 2/1971 | Melin | 214/750 X |
| 3,791,544 | 2/1974 | Moses | 214/620 |

*Primary Examiner*—L. J. Paperner
*Attorney, Agent, or Firm*—Edward J. Biskup

[57] ABSTRACT

An extractor device in the form of an attachment that is adapted to be slidably and pivotally supported by one of the two forks of a fork lift truck at an angle relative to the longitudinal axis of the truck so as to permit the latter to approach a rack at an angle, have the extractor device engage the underside of the rack, and permit the fork lift truck to apply a substantially straight-line horizontal pulling force on the rack as the fork lift truck moves in a rearward direction along a curved path.

5 Claims, 5 Drawing Figures

RACK EXTRACTOR DEVICE

The present invention concerns an extractor device that is adapted to be mounted on one of the two forks of a fork lift truck so as to permit a pulling force to be applied to a rack that is inaccessible for normal removal by the fork lift truck.

This invention is particularly useful in confined areas where a fork lift truck is unable to approach a rack or palletized load in a normal straight-ahead attitude for placing the forks into the usual fork openings provided in the rack or pallet. In such cases, the normal procedure calls for the operator to drive the fork lift truck at an angle to the load to be handled, insert the tip of one of the forks under a corner of the load, and through a knifing action cause one side of the load to be raised and lowered several times so as to slowly move it outwardly from its confined position. As is well known, this method of removing palletized loads or racks may require as many as 15 passes on the part of the fork lift truck before the load is removed. Apart from the large amount of time required to remove the load, frequently the lower structure of the pallet or the rack is damaged beyond repair due to the angled entrance of the fork into the channel-like openings in the pallet or rack.

Accordingly, the objects of the present invention are to provide a new and improved extractor device which facilitates the removal of racks and pallets from confined areas; to provide a new and improved extractor device which allows a rack or pallet to be withdrawn from confined quarters while the fork lift truck moves rearwardly at an angle relative to the direction of withdrawal of the load; to provide a new and improved extractor device which can be readily mounted on one of the forks of a fork lift truck without requiring the use of any tools; to provide a new and improved extractor device for a fork lift truck which includes a tongue that extends laterally outwardly from the fork when the device mounted thereon is formed with a vertically projecting hook that engages a part of the rack or pallet during an extraction operation; to provide a new and improved extractor device that is adapted to be supported by one of the forks of a fork lift truck through a slip-fit type connection which allows a limited amount of sliding and pivotal movement of the extractor device relative to the supporting fork during an extraction operation; and to provide a new and improved extractor device that is mountable on the fork of a fork lift truck by initially placing the device on a flat surface followed by driving the fork lift truck forwardly so as to cause one of the forks to move into an opening in the device until a relatively snug fit is realized.

The above objects and others are realized in accordance with the invention by providing an extractor device, which in the preferred form, comprises a mounting member having an opening formed therein. The opening has a cross sectional size that allows one of the two forks of a fork lift truck to be inserted into the opening and extend therethrough a predetermined distance until a snug fit between the mounting member and the fork is attained while allowing limited relative pivotal and sliding movement therebetween. An elongated tongue has its rear portion secured to the mounting member in a manner whereby the longitudinal center axis of the tongue is located at an angle relative to the longitudinal center axis of the supporting fork when the latter is inserted into the opening in the mounting member. In addition, a hook is fixed to the front portion of said tongue and projects therefrom so as to engage a portion of a rack or pallet and permit the fork lift truck to apply a substantially straight-line pulling force on the rack or pallet as the fork lift truck moves in a rearward direction along a curved path.

A more complete understanding of the invention will be derived from the following detailed description when taken with the drawings in which.

Figure 1:
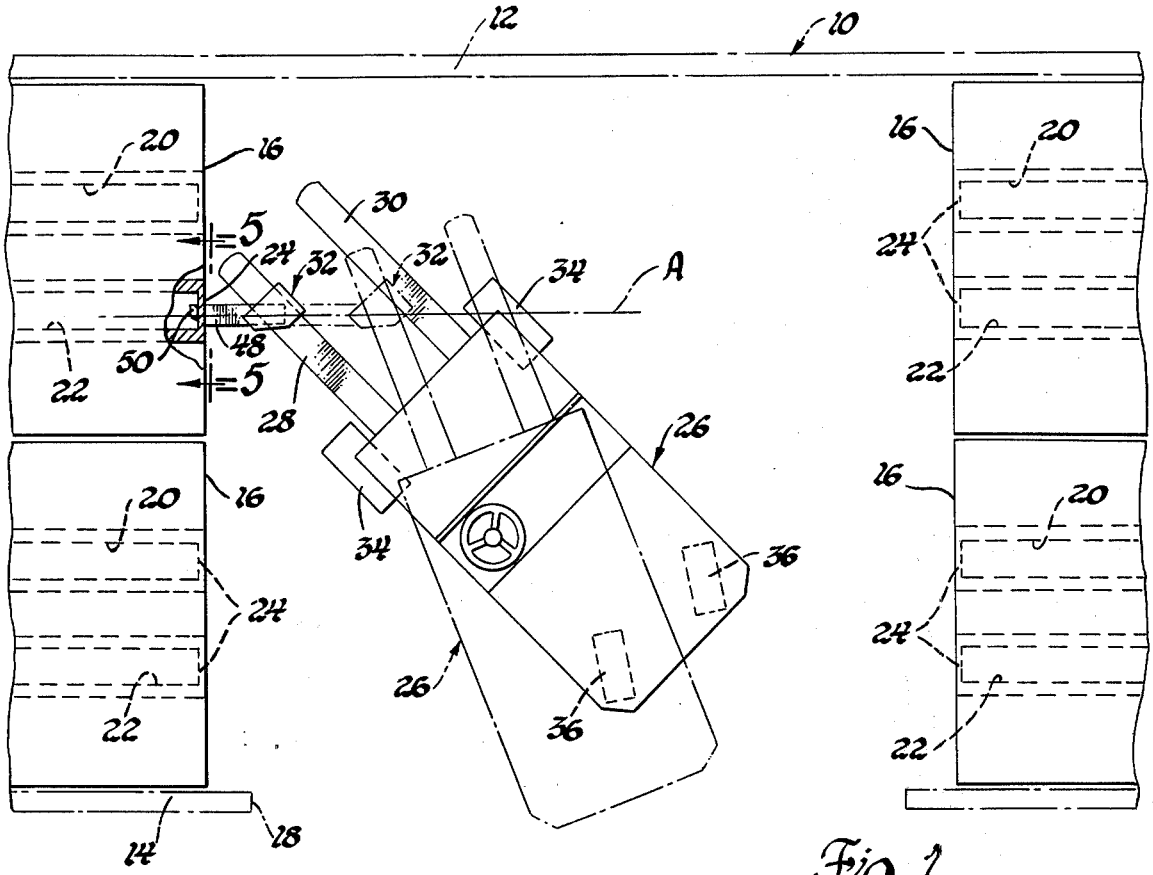
FIG. 1 is a schematic plan view showing a fork lift truck removing a rack from a railway freight car using an extractor device made according to the invention.
Figure 5:
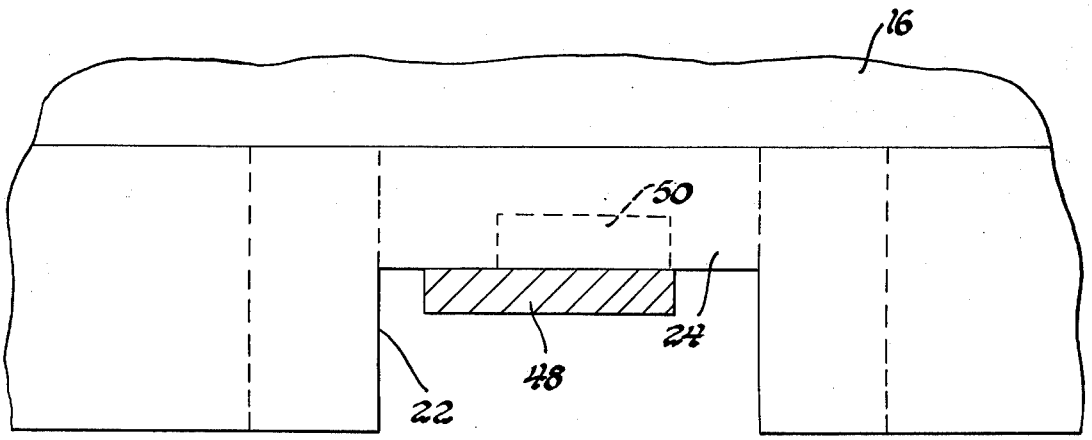
FIG. 5 is an enlarged view taken on line 5—5 of FIG. 1.

Referring to the drawings and more particularly FIG. 1, a plan view of a railway freight car 10 is shown having side walls 12 and 14 and a plurality of identical racks or palletized loads 16 positioned on opposite sides of the usual door opening 18 provided in the side wall 14 of the railway car. It will be understood that a palletized load consists of a pallet preferably made of wood and a load resting thereon, while a rack is a metal type container for parts or components that has an integral base. The invention can be used with either a rack or palletized load and each would be provided with parallel channel type openings 20 and 22 and a depending flange 24 as seen in FIGS. 1 and 5. It will also be understood that hereinafter the invention will be described as being used with a rack only, but it is intended that this term encompass a palletized load also.

As seen in FIG. 1, the space inside of the car 10 adjacent opening 18 and the length of each rack 16 is such that it is not possible for a fork lift truck 26 provided with forks 28 and 30 to approach the load in the usual straight-ahead fashion and extract it from the position as shown in FIG. 1. Accordingly, in order to alleviate this problem, the fork 28 of the fork lift truck 26 is provided with an extractor device 32 made according to the invention.

The fork lift truck 26 is shown in outline form only and includes a chassis provided with a pair of nonsteerable front wheels 34 and a pair of steerable rear wheels 36. The front end of the chassis includes the usual forks 28 and 30 which, although not shown, are supported by a mast which includes the usual mechanism for causing the forks to be raised and lowered in the usual manner.

Figure 2:
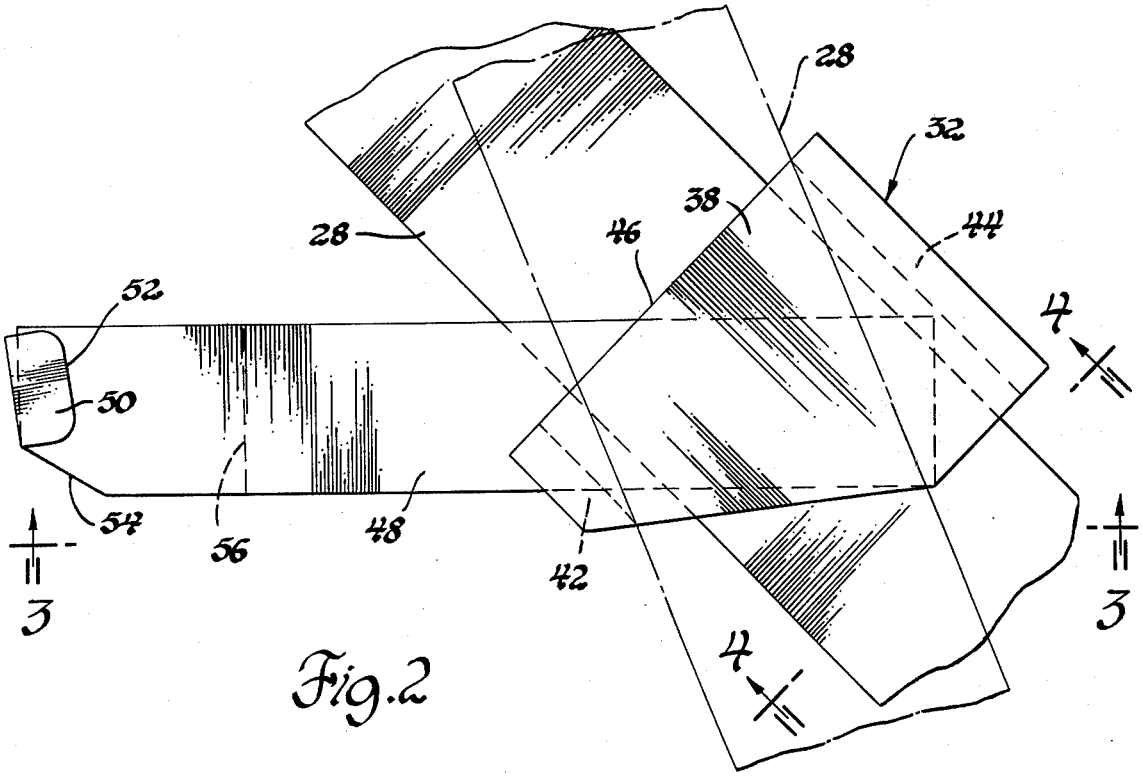
FIG. 2 is an enlarged view showing the extractor device of FIG. 1 mounted on one of the forks of the fork lift truck.
Figure 3:
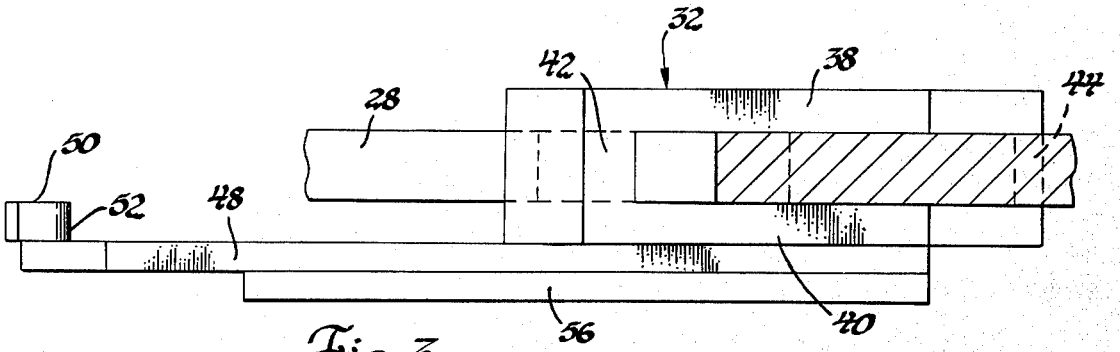
FIG. 3 is a view taken on line 3—3 of FIG. 2.

The extractor device 32 shown in the drawings is intended to be supported by the left fork 28 of the fork lift truck 26, and as seen in FIGS. 2 and 3, includes a mounting member which is formed by a pair of parallel plates 38 and 40 fixedly interconnected by a pair of vertical side walls 42 and 44 so as to define a generally rectangular opening for accommodating the fork 28 of the fork lift truck. As best seen in FIG. 2, the side wall 44 is approximately three times as long as the side wall 42 with the front edge 46 of plate 38 being perpendicular to the longitudinal axis of each side wall. Beneath the mounting member is an elongated tongue 48 the rear portion of which is rigidly secured to the plate 40. It will be noted that the longitudinal center axis of the tongue 48 is located at an angle to the longitudinal axis of each side wall 42 and 44 of the mounting member. In this instance, the included angle is approximately 55°.

The front portion of the tongue 48 is formed with an upstanding hook 50 having a contact surface 52 which is inclined relative to the longitudinal center axis of the tongue 48. In addition, it will be noted that the tongue 48 at the front end thereof has an inclined surface 54 which allows for easier entrance of the tongue 48 into the accommodating opening 22 provided in the racks 16 located to the left of the fork lift truck 26 as seen in FIG. 1. As seen in FIG. 3, a base plate 56, corresponding to the width and thickness of the tongue 48, is fixed with the undersurface of the tongue 48 and extends from the rear thereof forwardly to a point approximately two-thirds the length of the tongue. The base plate is rigidly fixed to the undersurface of the tongue 48 so when the extractor device 32 rests on a flat floor, the opening in the mounting member is at a level allowing easy entrance for the fork 28.

Figure 4:
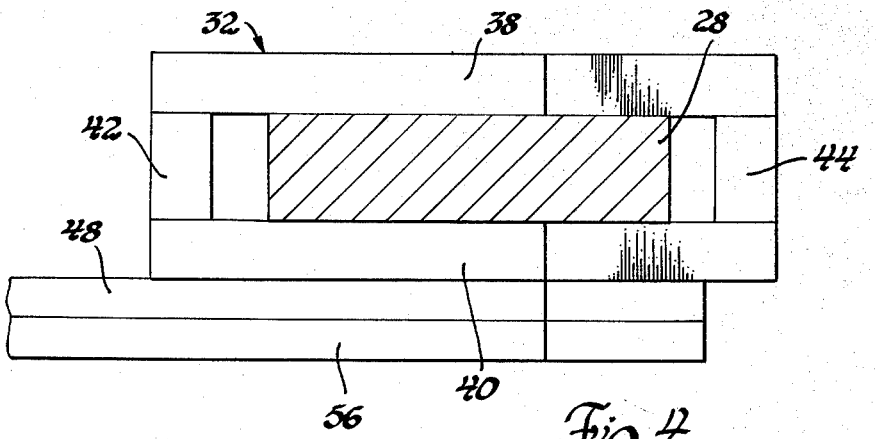
FIG. 4 is a view taken on line 4—4 of FIG. 2.

The extractor device 32 such as described above has been used with a fork lift truck having a pair of forks each of which was tapered from its heel to its outer tip and measured 1.75 inches at the heel, 5 inches wide and 42 inches long. As seen in FIG. 4 the rectangular opening in the mounting member measured 6.50 inches by 1.25 inches, and the tongue was 25 inches in length and three inches in width. As should be apparent, with such relative dimensions, the extractor device 32 was able to be slid on the fork to a point approximately midway between the heel and outer top of the fork 28 when the latter was inserted into the opening in the mounting member. At the midway point, the upper and lower horizontal surfaces of the fork engage the inner horizontal surfaces of the mounting member opening to thereby provide a somewhat snug fit with clearance existing between the opposed side edges of the fork 28 and the inner surfaces of side walls 42 and 44, as shown in FIG. 2 and 4.

In operation, the extractor device 32 can be mounted on the fork 28 either manually or simply by placing it on the floor and causing the fork lift truck operator to drive the fork 28 into the mounting member opening until the abovementioned snug fit is realized. As seen in FIG. 1, the fork lift truck is then driven into an angled position relative to the rack 16 to be extracted and the forward end of the tongue 48 is slowly inserted into one opening 22 provided in the rack. The forks 28, 30 are then raised so as to lift the corner of the rack 16 upward and cause the hook 50 to engage the flange 24 formed at the front of the rack. The rear wheels of the truck are then placed in a turned position and the truck is driven rearwardly along a curved path from the full line position to the dotted line position. During this rearward movement of the truck, the tongue 48 is drawn rearwardly in a substantially straight line path, as indicated by the letter A, causing the rack 16 to be withdrawn along a similar path. The rearward turning movement of the truck and as well as that of the attached forks is compensated for through the enlarged opening provided in the mounting member and the slip-fit type connection described hereinbefore. In other words, as the fork lift truck 26 moves rearwardly and is turning, the mounting member of the extractor device 32 can move forwardly along the fork 28 and also pivot about a vertical axis relative to the fork. Thus, a repositioning of the fork 28 relative to the mounting member is realized as it moves from the full line position to the dotted line position as shown in FIG. 2. This occurs due to the fact that the opening in the mounting member is of a width greater than the width of the fork 28 and also because the fork in side view tapered towards its outer tip. When the rack 16 has been partially extracted in a manner as described above, the extractor device 32 can be disconnected from the rack 16 by lowering the forks and once again respositioned to the midway point along the length of fork 28 as described hereinbefore. The extracting steps as described above are then repeated for removing the rack completely out of the railway car 10. Thus, in about two passes of the fork lift truck, the rack 16 can be removed from the railway car 10 through the door opening 18.

Various changes and modifications can be made in this construction without departing from the spirit of the invention. For example, the extractor device 32 can be designed for use with the right fork 30 for extracting the racks 16 located on the right hand side of the fork lift truck 26 as seen in FIG. 1. In such case, the extractor device 32 would be a mirror-image of the device shown in the drawings so that the tongue 48 would extend to the right of the fork 30. Such changes and modifications are contemplated by the inventors and they do not wish to be limited except by the scope of the appended claims.

The embodiments of the invention in which an exclusive property or privilege is claimed are defined as follows.

1. An extractor device adapted to be mounted on one of the two forks of a fork lift truck so as to permit a pulling force to be applied to a rack that is inaccessible to normal removal by the fork lift truck, said extractor device comprising a mounting member having an opening formed therein, said opening having a cross sectional size that allows said one of the two forks to be inserted into said opening and extend therethrough a predetermined distance until a snug fit between the mounting member and said one of the two forks is attained, an elongated tongue having a front portion and a rear portion, means securing the rear portion of said tongue to said mounting member whereby the longitudinal center axis of said tongue is located at an angle relative to the longitudinal center axis of said one of the two forks when the latter is inserted into the opening in the mounting member, and a hook fixed with the front portion of said tongue and adapted to engage a portion of the rack and permit the fork lift truck to apply a substantially straight-line pulling force on the rack as the fork lift truck moves in a rearward direction along a curved path.

2. An extractor device adapted to be mounted on one of the two forks of a fork lift truck so as to permit a pulling force to be applied to a rack that is inaccessible to normal removal by the fork lift truck, said extractor device comprising a mounting member having an opening formed therein, said opening having a generally rectangular cross section and being of a size that permits said one of the two forks to be inserted into said opening and extend therethrough a predetermined distance until a snug fit between the mounting member and said one of the two forks is attained while allowing limited relative pivotal movement between said mounting member and said one of the two forks, an elongated tongue having a front portion and a rear portion, means securing the rear portion of said tongue to said mounting member whereby the longitudinal center axis of said tongue is located at an angle relative to the longitudinal center axis of said one of the two forks when the latter is inserted into said opening in said mounting member, and a hook fixed with the front portion of said tongue and adapted to engage a portion of the rack and permit the fork lift truck to apply a substantially straight-line pulling force on the rack as the fork lift truck moves in a rearward direction along a curved path.

3. The extractor device of claim 2 wherein said opening is defined by a pair of side walls, a top plate and a bottom plate, one of said pair of side walls being of a length substantially greater than the other of said pair of side walls.

4. The extractor device of claim 2 wherein said hook has a contact surface located in a plane inclined to the longitudinal axis of said tongue.

5. An extractor device adapted to be mounted on one of the two forks of a fork lift truck so as to permit a pulling force to be applied to a rack that is inaccessible to normal removal by the fork lift truck, said extractor device comprising a mounting member having an opening formed therein, said opening being generally rectangular in cross section and of a size that allows said one of the two forks to be inserted into said opening and extend therethrough a distance approximately one-half the length of said one of the two forks and until a snug fit between the mounting member and said one of the two forks is attained while allowing limited relative pivotal movement therebetween, an elongated tongue having a front portion and a rear portion, means securing the rear portion of said tongue to said mounting member whereby the longitudinal center axis of said tongue is located at an angle relative to the longitudinal center axis of said one of the two forks when the latter is inserted into the opening in the mounting member, and an upstanding hook fixed with the front portion of said tongue and adapted to engage a portion of the rack and permit the fork lift truck to apply a substantially straight-line pulling force on the rack as the fork lift truck moves in a rearward direction along a curved path.

* * * * *